US005851072A

United States Patent [19]

LaFleur

[11] Patent Number: 5,851,072

[45] Date of Patent: Dec. 22, 1998

[54] SPOUT CONSTRUCTION FOR BULK BOX LIQUID LINER

[75] Inventor: Lee LaFleur, Mainstee, Mich.

[73] Assignee: Custom Packaging Systems, Inc., Manistee, Mich.

[21] Appl. No.: 756,990

[22] Filed: Nov. 26, 1996

[51] Int. Cl.[6] ..... B65D 33/36

[52] U.S. Cl. ..... 383/66; 383/41; 383/109; 383/202; 383/906; 220/258

[58] Field of Search ..... 383/66, 80, 81, 383/200, 202, 203, 96, 906, 41, 109; 220/256, 258

[56] References Cited

U.S. PATENT DOCUMENTS

| | | | |
|---|---|---|---|
| 2,438,351 | 3/1948 | Spanel | 383/906 X |
| 3,173,579 | 3/1965 | Curie et al. | 383/96 X |
| 4,518,106 | 5/1985 | Lafleur . | |
| 4,596,040 | 6/1986 | LaFleur et al. . | |
| 4,781,472 | 11/1988 | LaFleur et al. . | |
| 4,781,473 | 11/1988 | LaFleur . | |
| 4,781,475 | 11/1988 | LaFleur . | |
| 4,790,029 | 12/1988 | LaFleur et al. . | |
| 4,813,578 | 3/1989 | Gordon et al. | 220/258 X |
| 4,817,824 | 4/1989 | LaFleur et al. . | |
| 4,909,434 | 3/1990 | Jones et al. | 220/258 X |
| 5,087,235 | 2/1992 | LaFleur . | |
| 5,104,236 | 4/1992 | Lafleur . | |
| 5,127,893 | 7/1992 | LaFleur . | |
| 5,328,268 | 7/1994 | LaFleur . | |
| 5,348,182 | 9/1994 | Luch | 220/258 X |
| 5,348,184 | 9/1994 | Adams et al. | 220/256 X |
| 5,358,335 | 10/1994 | LaFleur . | |
| 5,385,268 | 1/1995 | LaFleur et al. . | |
| 5,397,013 | 3/1995 | Adams et al. | 220/256 |
| 5,421,804 | 6/1995 | LaFleur . | |

FOREIGN PATENT DOCUMENTS

| | | | |
|---|---|---|---|
| 5077842 | 3/1993 | Japan | 383/906 |

*Primary Examiner*—Jes F. Pascua
*Attorney, Agent, or Firm*—Barnes, Kisselle, Raisch, Choate, Whittemore & Hulbert, P.C.

[57] ABSTRACT

An improved bulk bag or bulk box liner and spout fitment construction for the liner discharge and/or fill openings. The liner is of liquid impervious thermoplastic multiple-ply sheet material, and the spout fitment is a rigid thermoplastic spout of either open or closed flange type. The spout tube extends through the liner fitment opening and has an external flange base adjacent the liner-interior tube end that is permanently affixed and heat sealed to the liner in a first annular heat weld zone formed between an outward facing surface of the flange base and the interior surface of the liner. A first backing piece of liquid impervious plastic sheet material overlies the inward-facing flange surface and has a marginal portion overlying the liner interior surface. A second annular heat seal is formed between this backing piece and flange base in a second annular weld zone spaced radially inwardly from the first heat weld seal zone. A third annular heat seal is formed between the backing piece marginal portion and the liner interior surface in a third heat annular weld zone spaced radially outwardly from the first heat weld zone. The spout-liner construction is thus held in assembly by the three separate and distinct concentric weld zones. The attachment of backing seals to the flange base is separate and distinct from the attachment of the three liner plies to the opposite surface of the flange base. Likewise, the attachment of the two larger diameter backing pieces at their outer edge to the inner ply of the liner wall is separate and distinct from both of the aforementioned attachment and sealing weld zones. When the rigid spout is of the "open flange" type, the backing piece has an aperture to fit in close surrounding relation to the flange tube with the flange base end protruding through the backing piece aperture into the interior of the liner. When the spout is of the "closed flange" type, the backing piece is imperforate and pierceable to open the spout tube liner-interior end for discharge of liquid therethrough from the liner interior.

15 Claims, 2 Drawing Sheets

SPOUT CONSTRUCTION FOR BULK BOX LIQUID LINER

FIELD OF THE INVENTION

This invention relates to a shipping and storage container and, more particularly to a rigid spout and flexible plastic liner construction for use primarily with bulk box applications for shipping liquids in bulk boxes (wood, steel, plastic, corrugated, etc.), and also for use with a large bulk liquid-container of the collapsible bag type.

BACKGROUND OF THE INVENTION

Many products, such as granular and liquid materials, are shipped and stored in large bulk bags adapted to hold as much as a ton or more of material. The use of bags for this purpose has become popular because the bags can be shipped from the manufacturer to the material shipper in a generally flat condition and, if properly designed, when empty can be returned by the user to the shipper in the same generally flat condition for reuse. Commercially successful examples of such bags are disclosed and claimed in U.S. Pat. Nos. 4,518,106; 4,596,040; 4,781,472; 4,781,473; 4,781,475; 4,790,029; and 4,817,824; 5,087,235; 5,104,236; 5,127,893; 5,328,268; 5,358,335; and 5,142,804, all assigned to Custom Packaging Systems, Inc., assignee of record herein, and incorporated herein by reference.

In addition, it is desirable, as set forth in the above identified patents, to provide the bulk bags with loose and attachable leak proof liners made of liquid and moisture impervious inexpensive plastic sheet material which form-fit within the container bag without pleats or folds in the liner when filled so that no abnormal stress is put on the liner, the bulk bags can be filled to maximum capacity, and no valuable product is trapped in the pleats or folds of the liner. Such liners eliminate dusting or splashing and container odors during filling or discharging cycles in use of the bags. Such liners are constructed for insertion into any style bulk bag and are easily filled. The liners do not elongate out of the bottom of the bulk bag during discharge due to their attachment features to the exterior bag, such as tape-tab and sewing techniques which holds the liner permanently in place, or a tape-tab and tied feature which allows removal of a used liner and a new liner to be inserted and tied into the bag, thereby allowing reuse of the outer bag. Use of such liners in the outer bulk bags saves on cleaning, storage of waste, and container replacement costs. Additionally, liners constructed in accordance with the aforementioned patent disclosures may be quickly inserted into the outer woven bag and inflated in seconds to correctly fit the bag container.

The liners can be provided in a variety of single or multi-ply plastic sheet materials to prevent problems related to corrosion, oxygen, moisture, conductivity, high temperature, and static electricity. Additionally, such bulk liquid bag liners can be provided with rigid inlet and/or outlet spout fitments to control liquid product inflow and outflow and easy closure.

Despite the many advantageous characteristics and features of the aforementioned patented bulk bag and liner constructions, there remains a need to improve the attachment connection of the rigid spouts as used in inlet and discharge liner fitments to the liner in a secure, liquid-tight and leak proof manner. Typically such rigid spouts are commercially available as separate components and injection molded of suitable plastic materials. The cylindrical tube barrel that defines the main conduit of the spout is normally provided with an integral outwardly extending flange base that encircles the barrel and is adapted for attachment to the single or multi-ply plastic material of the liner, which in turn is suitably apertured to receive the spout therethrough. Typically, such rigid spout fitments are referred to in the trade as a "fill flange" and "discharge flange" because of their characteristic mounting flange base portion, which in turn is often referred to as the "flange base".

Such commercially available fill and discharge flanges may be of the "open flange" type, which means that the spout barrel may be provided with an externally or internally threaded portion adapted to threadably receive a removable closure plug or cap that is accessible externally of the liner to open and close the flange. Another type of such flange is the "closed flange" type that is initially manufactured in closed condition by attachment thereto a sheet of sealing material adhesively attached, as by a heat seal weld, to the flange base so that the closed flange can only be opened by piercing this seal piece, to rupture it and thereby open the flange after external coupling connections have been made to an external fill or discharge hose or conduit.

Typically, in manufacture of prior liner constructions employing such fill and discharge flanges, one or more plies of thermoplastic liner sheet material were heat sealed to the thermoplastic material of the flange base by use of a heat sealing head fixture of the either the induction heater or ultrasonic welding type, such as that disclosed in U.S. Pat. No. 3,916,148 and referenced in the above-noted U.S. Pat. No. 5,087,235, both incorporated herein by reference. This created a single annular zone of a fused ring of heat welded fused plastic material that was formed between the liner ply and the base surface encircling the flange barrel. In the case of closed flange, either simultaneously or successively, one or more barrier seal pieces thermoplastic sheet material were often heat sealed to the opposite side of the flange base to form an interior seal membrane, the fusion welding zone being aligned or registered with that of the ply or plies welded to the opposite side of the flange base.

It has been found that this prior spout-to-liner attachment construction, although generally satisfactory under most usage conditions, in some instances has not provided a leak-proof spout fitment system. Such fitments are subject to occasional development of "leakers" due to "over cooked" seals, resulting when the heat weld joint is stressed in tension, in a tearing action along a seal edge, thereby causing leaking next to the outside of the seal edge during bag transit, or even before filling the bag liner with any liquid at all. It will be understood that, particularly in the case of discharge fitments for bulk liquid bag liners, that the same are subjected to severe hydraulic stresses from the weight of the filled bag liquid contents while in transit, and to additional shock stresses from bumping or mishandling while being moved from storage to the discharge station as by forklifts, overhead cranes and the like. In addition, in the prior manufacture of such spout-to-liner constructions several separate manufacturing steps are often required that involve rehandling of the product and therefore increased possibility of processing errors and defects resulting from successive tolerance stack-ups.

OBJECTS OF THE INVENTION

Accordingly, among the objects of the present invention are to provide an improved liner fill and/or discharge spout fitment construction, preferably employing commercially available open or closed type rigid flanges components, which is economical to manufacture and yet which provides enhanced liquid-tight sealing characteristics, that can safely withstand greater static hydraulic stresses than prior liner spout fitment constructions so as to assure that the discharge and fill fitments will be secure and leak-proof in storage and use, which has an improved ability to absorb the dynamic hydraulic and mechanical stress loads placed on the flange while a filled bag is in transit, which enables reduced handling of the liner and spout component materials during construction and readily lends itself to improvements in process control and subsequent product quality as a result of less handling, enhanced monitoring capabilities, defect traceability and simplified production procedures.

A further object is to provide an improved method of constructing a bulk box liner and spout fitment assembly for economically, reliably and consistently achieving an improved liner and fitment construction of the aforementioned character.

SUMMARY OF THE INVENTION

In general, and by way of summary description and not by way of limitation, the invention achieves the foregoing objects by providing an improved liner spout fitment construction for the liner discharge and/or fill openings through which liquid contents are respectively discharged from and filled into the liner. Typically the liner is made from a tubular blank of liquid impervious plastic sheet material, and the spout fitment is mounted in one of such liner openings. The fitment preferably comprises a commercially available self-supporting rigid spout of either open or closed flange type and having a generally cylindrical tube extending through the liner fitment opening and open at its opposite ends. The spout flange also has an external rigid flange base adjacent the liner-interior tube end that extends radially outwardly in encircling relation to the tube. The spout flange is permanently affixed and sealed to the liner in a first annular heat weld zone by a circumferentially continuous first annular heat seal formed in and between a first surface of the flange base and the interior surface of the liner and encompassing the liner opening within the liner interior. A first backing piece of liquid impervious plastic sheet material overlies a second base flange surface opposite the base flange first surface. This backing piece is constructed and arranged to radially encompass the liner-interior tube end and to have a marginal portion protruding radially outwardly beyond the peripheral edge of the flange base overlying the liner interior surface. A second annular heat seal is formed between this backing piece and flange base in a second annular weld zone spaced radially inwardly from the first heat weld seal zone. A third annular heat seal is formed between the backing piece marginal portion and the liner interior surface in a third heat annular weld zone spaced radially outwardly from the first heat weld zone.

Preferably the liner wall comprises a plurality of plies of the plastic sheet material and all of such plies are joined to one another and to the flange first surface by the first annular heat seal formed in the first annular weld zone.

In one embodiment the rigid spout is of the "open flange" type, and the backing, piece has an aperture to fit in close surrounding relation to the flange tube with the flange base end protruding through the backing piece aperture into the interior of the liner.

In another embodiment the spout is of the "closed flange" type, and the backing piece is imperforate and pierceable to open the spout tube liner-interior end for discharge of liquid therethrough from the liner interior. An imperforate and pierceable plastic sheet seal piece is interposed between the backing piece and base flange surface and joined to the backing piece and flange base by the second heat seal. Preferably, the peripheral edge of the seal piece is generally flush with the peripheral edge of the flange base. A second backing piece of liquid impervious imperforate and pierceable plastic sheet material overlies the first backing piece and has a peripheral edge generally flush with the peripheral edge of the first piece marginal portion. The second backing piece is joined to the first backing piece by a heat seal formed therebetween and disposed in the third annular weld zone.

It thus will be seen that the spout-liner construction is held in assembly by three discrete concentric weld zones. The attachment of backing seals to the flange base is separate and discrete from the attachment of the three liner plies to the opposite surface of the flange base. Likewise, the attachment of the two larger diameter backing pieces at their outer edge to the inner ply of the liner wall is discreet from both of the aforementioned attachment and sealing weld zones. Hence, any production imperfection that may creep in to any one of these attachments heat weld zones will not affect the liquid sealing provided by the remaining two attachment zones. Moreover, the stresses imposed by the hydraulic forces created by the liquid contents of the bag tending to place the various plastic sheets in tension relative to the flange base are well distributed through the three zones of welded attachment to thereby better withstand such rupture-inducing stress loads.

In addition, there is no danger that, in performing the welding procedure in each of these discrete, radially spaced weld zones, "overcooking" can occur with respect to a previously formed weld ring. Accordingly, the liner/spout construction of the invention avoids weakening of the weld ring joints or otherwise potentially introducing a sealing defect which could contribute to product leakage under the stresses encountered by the liner/spout construction in its normal intended use.

BRIEF DESCRIPTION OF THE DRAWINGS

The foregoing as well as other objects, features and advantages of the present invention will become apparent from the following detailed description of preferred but exemplary embodiments of the invention and of the best mode presently known for making and using the invention, and from the appended claims and accompanying drawings, in which:

DETAILED DESCRIPTION OF THE PREFERRED EMBODIMENTS

First Embodiment

Figure 1:
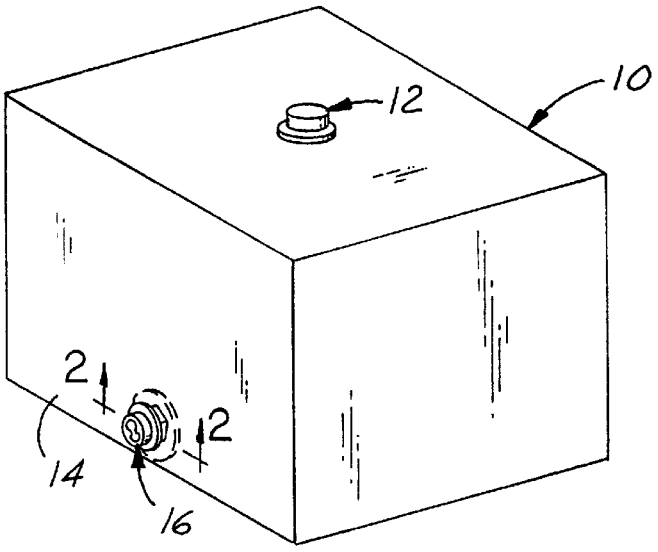
FIG. 1 is a simplified perspective view of a bulk box liner as it appears when full when resting on a flat supporting surface and confined laterally such as by a square open-ended reinforcing container (not shown), and embodying a first embodiment discharge fitment construction of the invention.

Referring now in more detail to the accompanying drawings, FIG. 1 illustrates a first embodiment of a plastic liner 10 shown by itself prior to insertion into an associated bulk-liquid material box, bulk bag or other container of the aforementioned type. Liner 10 is shown diagrammatically as it would appear when filled and confined in a rectangular outer restraining container. Preferably, liner 10 of the first embodiment is constructed of 4 millimeter thickness, ultraviolet resistant, low density polyethylene of from 1–3 ply thickness to provide a high strength liquid impermeable interior lining for the associated outer bulk bag. The upper end of liner 10 is provided with a standard rigid fill flange 12, which may be of type commercially available and known as an L.B. Transport flange with cap or a Waddington Duval fill flange with Tri-Sure plug, and attached to the liner in a conventional manner. There are several other brands of suitable flanges. Liner 10 may be constructed similar to liner 92 described in conjunction with FIG. 18 of the aforenoted U.S. Pat. No. 4,596,040 incorporated herein by reference and therefore not further described in detail.

Figure 2:
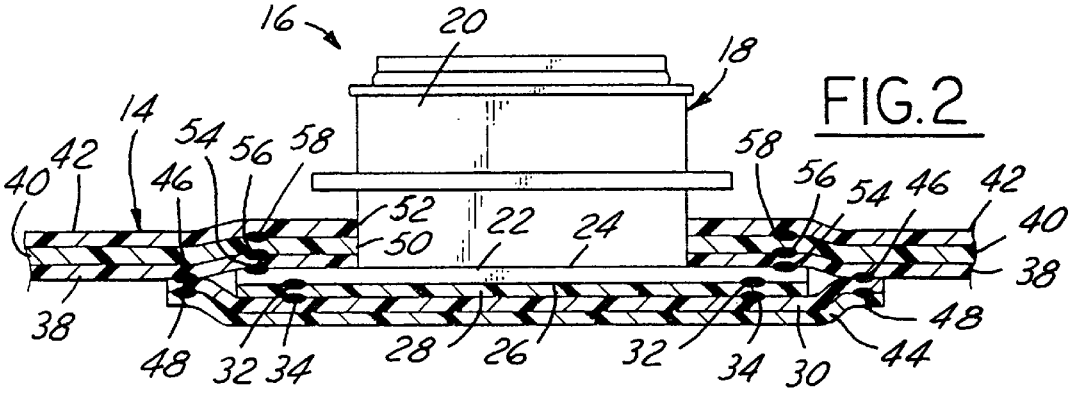
FIG. 2 is a part elevational, part sectional fragmentary view taken on the line 2—2 of FIG. 1 illustrating the discharge fitment of FIG. 1 greatly enlarged thereover and showing of the final sealing step, sealing all plies of the liner to the outer flange seal surface.

One of the side wall panels 14 of liner 10 is provided adjacent its lower edge with a rigid dispensing spout construction 16 in accordance with the present invention and shown in more detail with reference to FIG. 2. The liner/spout construction 16 includes a commercially available discharge flange 18, such as a 2 inch diameter rigid Waddington Duval flange, which is injection molded of suitable thermoplastic material and has a cylindrical barrel 20 provided with an interior throughbore (not shown) and having a thin flat flange base 22 protruding radially outwardly from its interior end. Base 22 typically is circular in plan configuration with parallel flat top and bottom surfaces 24 and 26 but may also be rectangular or square and a suitably shaped heat sealing device would be used.

Figure 3:
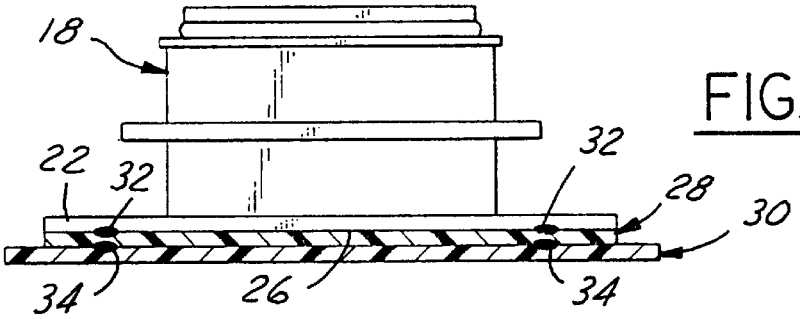
FIG. 3 is a part elevational, part center sectional view of the closed flange of FIGS. 1 and 2, illustrating a first step wherein two seal members are applied as a multiple ply seal laminate to the underside of the flange base in a separate manufacturing step in the performance of the method of the invention.

In order to construct the spout-liner construction 16 in accordance with the method of the invention, and as shown in FIG. 3, a first assembly step is performed "out of line", i.e., separate from the subsequent manufacturing production line procedures employed in attaching dispensing flange 18 to the three plies of liner 14. The sub-assembly of FIG. 3 is thus made by attaching to flange base 22 two thin sheets 28 and 30 of thermoplastic backing material, such as ultraviolet resistant, low density polyethylene, to form a two-ply liquid imperforate seal barrier across the inner end of barrel 20. The uppermost seal ply piece 28 preferably has the same diameter of base 22 and is registered with its outer edge flush with that of base 22. The lowermost ply piece 30 of the sub-assembly preferably is likewise circular in plan, but made of a predetermined larger diameter, for example 125% of the diameter base 22, and arranged concentrically with ply 28 and base 22. As diagrammatically illustrated in FIG. 3, ply 28 is heat sealed and attached by a circular ring weld 32 to the underside 26 of base 22, and ply 30 is also sealed and attached by a circular ring weld 34 to the underside of ply 28. Preferably, the two weld rings 32 and 34 are formed concurrently on the same weld zone by fixturing the stack-up of base 22, ply 28 and ply 30 as shown in FIG. 3 against conventional electric heat sealer bars in a circular configuration such as disclosed in U.S. Pat. No. 3,916,148, as is well understood in the art.

Figure 4:
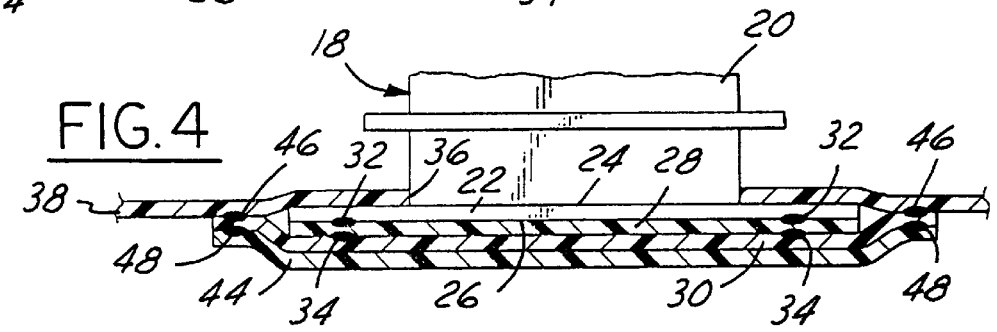
FIG. 4 illustrates a second step of a method wherein the intermediate product of FIG. 3 is assembled to an innermost ply of the multiple-ply liner in performing the method of the invention, the innermost ply and closed flange being shown fragmentarily.

The next step in the method is illustrated in FIG. 4. In this step the sub-assembly of FIG. 3 is brought against the innermost ply 38 of the three-ply side panel 14 of liner 10, and barrel 20 inserted outer end first through a suitable opening 36 provided in ply 38 so as to bring the undersurface of ply 38 flush against upper surface 24 of flange base 22. The two outer plies 40, 42 (FIG. 2) of side wall 14 are held spaced away from the outer end of flange 18 during this procedure. Then a third circular seal backing piece 44, having the same diameter as backing piece 30, is laid against backing 30 within the outer edge flush. Backing pieces 30 and 44 are then fixed to inner liner ply 38 by forming a heat seal ring weld 46 between backing piece 30 adjacent its outer edge, and likewise a second heat seal weld ring 48 between backing 44 and backing 30 in registry with weld 46. Preferably, the ring welds 46 and 48 are formed simultaneously in the same weld zone by fixturing the three-ply stack up of liner ply 38 and pieces 30 and 44 in a suitable conventional electric heat welding head aligned concentrically over the welding zones where weld rings 46 and 48 are to be so formed.

As shown in simplified form in the in-line production progression from FIG. 4 to FIG. 2, in the next step in the method of constructing the spout-liner fitment 16, the two outer plies 40 and 42 are suitably apertured to provide openings 50 and 52 therein, and then barrel 20 inserted outer end first therethrough to bring these plies down flat against ply 38, as shown in FIG. 2. Then all three plies 38, 40 and 42 of liner wall 14 are affixed to top surface 24 of flange base 22 by forming three mutually registered weld rings 54, 56, and 58 disposed respectively between inner ply 38 and the top surface 24 of base 22, between plies 38 and 40 and between plies 40 and 42, as shown in simplified form in FIG. 2. Again, preferably, the three weld rings 54, 56 and 58 are formed concurrently in the same weld zone by fixturing the three-ply stack up 38, 40 and 42 against base 22 with a suitable electric heat sealing or welding bars in a fixture aligned with this weld zone 54, 56, 58.

With spout-liner construction 16 completed as shown in FIG. 2 the same is now ready for use with the flange 18 securely affixed to liner side wall 14 and sealed by three liner-interior barrier layers 28, 30, and 44 spanning in liquid-tight relation the inner end of the throughbore of flange barrel 20. It will also be seen that the spout-liner construction is held in assembly by three separate or distinct weld zones: (1) the radially innermost weld zone 32, 34, (2) the radially outermost weld zone 46, 48; and (3) the radially intermediate weld zone 54, 56, 58. Thus the attachment of backings seals 28 and 30 to base 22 is separate and distinct from the attachment of the three liners plies 38, 40 and 42 of the liner wall 14 to the opposite surface 24 of base 22. Likewise the attachment of the two larger diameter backing pieces 30 and 44 at their outer edge to the inner ply 38 of the liner wall is separate and distinct from both of the aforementioned attachment and sealing weld zones. Hence, any production imperfection that may creep into any one of these attachments zones will not affect the liquid-tight sealing provided by the remaining two attachment zones. Moreover, the stresses imposed by the hydraulic forces created by the liquid contents of the bag tend to place the various plastic sheets in tension relative to flange base 22 are well distributed through the three zones of welded attachment to thereby better withstand such rupture-inducing stress loads.

When the contents of the bag containing liner 10 are to be discharged, the interior liquid seal provided by the three plies 28, 30 and 44 are opened by cutting out their central area aligned with the interior bore of the barrel 20, as by use of a suitable piercing tool to thereby allow liquid contents to fill therethrough and out of flange 18 into an associated hose or other discharge conduit. However, it will be noted that even after these three interior barrier plies are ruptured the same remain attached to base 22 as well as to inner liner 38 through the two discrete weld zones 32, 34, and 46, 48 respectively. Hence the additional reinforcement of the attachment of the three-ply wall 14 to flange 18 remains intact and in sealed relation to prevent leakage past the exterior of flange 18 from the interior of liner 10.

Second Embodiment

Figure 6:
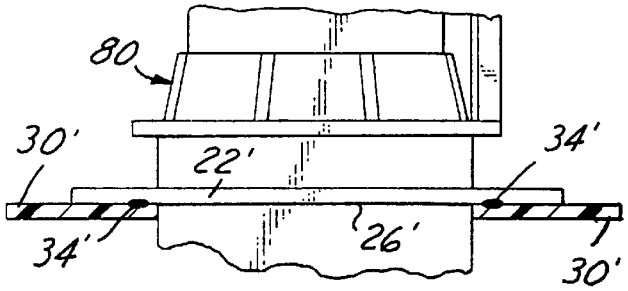
FIG. 6 is a fragmentary, part elevational, part sectional view illustrating a first step in the method of constructing the embodiment of FIG. 5.
Figure 7:
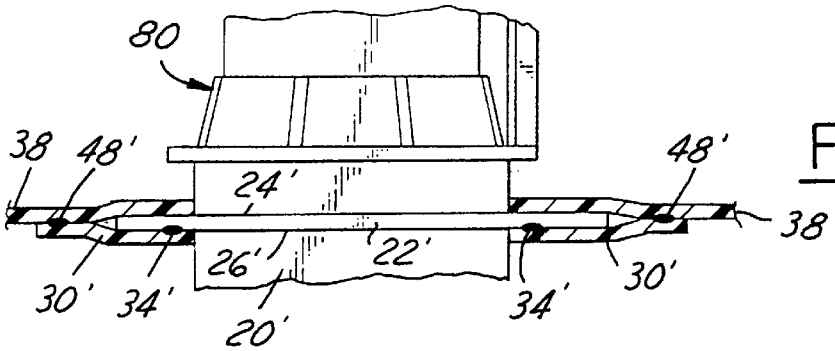
FIG. 7 is a view similar to that of FIG. 6 illustrating a second step in the method of constructing of the embodiment of FIG. 5.
Figure 8:
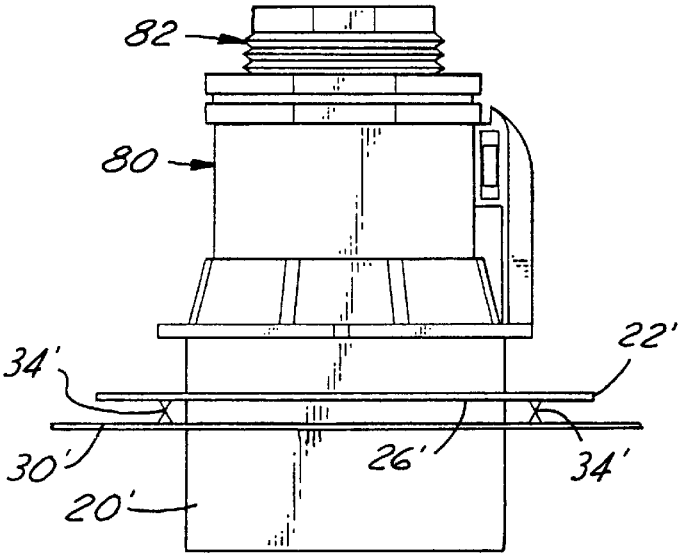
FIG. 8 is a view of illustrating the open flange fitment in elevation and diagrammatically illustrating the first step being performed in FIG. 6.

FIGS. 5–8 illustrate a second embodiment of a liner/spout construction 16' wherein elements previously described are given like reference numerals, and those alike in structure and function are given like reference numerals raised by a prime suffix, and their description not repeated. In the second embodiment of the liner/spout construction 16' of the invention, the application of the principles of the invention are shown applied to a rigid discharge spout 80 of the "open flange" type, such as that commercially available as a Scholle Buttress Plug, a Waddington Duval flange with Tri-Sure plug or a L.B. Transport flange with cap. As best seen in FIG. 8, flange 80 has a cylindrical barrel 20', a straight through-flow passage open at both ends of the fitment (not shown), and a threaded spout neck 82 threadably receiving a removable sealing cap (not shown). Spout 80, like spout 18, has an external flange extending integrally from barrel 20' to form the thin, flat, circular flange base 22'.

Figure 5:
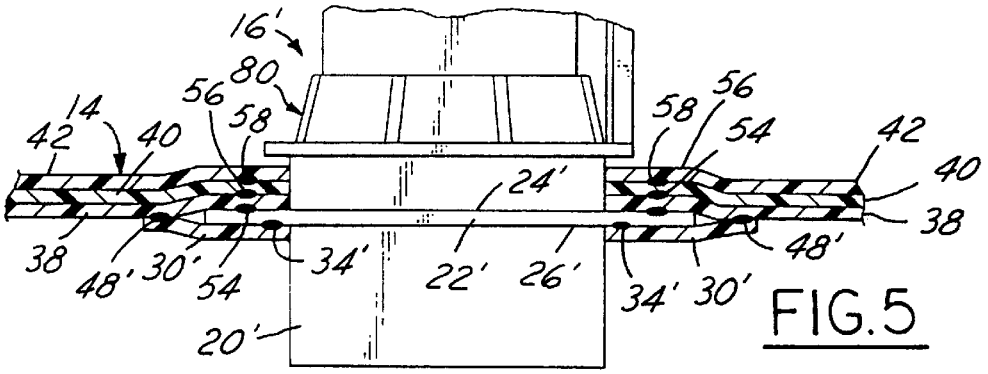
FIG. 5 is a fragmentary, part elevational, part center sectional view of a liner-to-spout construction of a second embodiment of the invention employing an open flange fitment constructed in accordance with the method of the invention.

The first step of the method of the invention employed in constructing liner/spout 16', shown in finished form in the simplified view of FIG. 5, is illustrated diagrammatically in FIG. 8. A circular backing piece 30', which may be of the same material as one of the plies 38–42 of liner wall 14, is circularly apertured to slip over the lower end of barrel 20' of flange 80 so as to closely encircle barrel 20', and is brought against the undersurface 26' of flange base 22' and then affixed thereto in a first weld zone by a heat seal ring weld 34' concentrically encircling barrel 20' and spaced slightly radially outwardly therefrom. Backing piece 30' is diametrically dimensioned to protrude radially outwardly beyond the outer edge of flange base 26' as so affixed, as illustrated in the corresponding view of FIG. 6. Preferably, the diameter of piece 30' exceeds that of flange base 22' by approximately 125%. Again, it is to be understood that the performance of the first step illustrated in FIGS. 6 and 8, i.e., the affixation of backing piece 30' to flange 80, is preferably performed as an "out of line" procedure performed at a production station separate from the remaining in-line assembly construction of liner/spout 16'.

In the next step of the second embodiment method, as illustrated in FIG. 7, the innermost ply 38 of liner wall 14 is suitably circularly apertured to slip over the upper end of spout 80 so that when laid on upper surface 24' of flange base 22' the same closely encircles flange barrel 20' and rests on upper surface 24'. Then the outer margin of backing piece 30' is affixed to the liner-interior surface of ply 38 in a second weld zone by a heat seal ring weld 48', again as by employing a suitable conventional electric heater bar welding head fixture. Welding 48' is located adjacent the outer edge of backing piece 30' and is spaced radially outwardly away from the outer edge of flange base 22', similar to weldings 46 and 48 of the first embodiment. Also, it is to be understood that in the performance of the second step illustrated in FIG. 7, the outer two plies 40 and 42 of liner wall 14 are held spaced away from flange 80 and innermost ply 38 so as not to interfere with the performance of this step.

In the final step of the second embodiment method the outer two plies 40 and 42 of liner wall 14 are suitably cut to form a circular hole, the cut-out film being removed and discarded, and then these other two plies brought to their assembled position on flange 80 as shown in FIG. 5. Then the aforementioned weld rings 54, 56 and 58 are formed in a third weld zone as in the manner of the first embodiment to sealably join together the three plies 38, 40 and 42 and to securely affix this welded lamination to upper surface 24' of flange base 22'. It is again to be noted that the annular zone of weld rings 54, 56 and 58 is separate and distinct from and disposed radially of flange 80' intermediate the innermost weld zone of weld ring 34 and the outermost weld zone of weld ring 48'. Hence, there is no danger that, in performing the welding procedure in each of these separate and distinct, radially spaced weld zones, "overcooking" can occur with respect to a previously formed weld ring. Accordingly, the liner/spout construction of the invention avoids the welding joints or otherwise potentially introducing a sealing defect which could contribute to product leakage under the stresses encountered by the liner/spout construction 16' in its normal intended use.

ADVANTAGES

In addition to the advantages described previously, from the foregoing description it will now be understood by those skilled in the art that the leak proof discharge system, construction and method of the invention amply fulfills the foregoing objects and provides many additional advantages. The improved structural integrity of the liner/spout constructions 16 and 16' is such that they provide the ultimate in customer satisfaction in that the customer can be assured that their bulk liquid bag discharge fitments will be secure and leak proof. The integrity of the multiple backings 28, 30, and 34 for the closed flange construction 16 and the independent arrangement of the separate and distinct weld ring attachment and sealing zones provides an improved ability to absorb the hydraulic stresses placed on the flange while in transit. Moreover, even after barrier seal pieces 28, 30 and 44 are punctured to open the fitment for bag content discharge weld rings 32 and 34 and 46 and 48 remain intact as barriers against leakage around the discharge fitment. Likewise, in the case of the open fitment construction 16' of the second embodiment, the internal backing piece 30' provides an independent safeguard against leakage that supplements the weld zone rings 54, 56 and 58, both during transit and content discharge.

The fitment construction of the invention also lends itself to improved manufacturing efficiency through reduced handling of product and enables several existing processes to be integrated into fewer steps. Process control and subsequent product quality is also improved as a result of less handling, enhanced monitoring capabilities, traceability and simplified production procedures. The initial steps in the construction of the first and second embodiments illustrated respectively in FIGS. 3 and 6, 8 are readily done as an out-of-line procedure to form sub-assemblies, thereby ensuring improved product integrity and enhanced hygienic procedures.

The liner/spout construction of the invention has been found to overcome the problem of "over cooked" seals of prior liner-spout constructions that resulted in a tearing action along a seal edge, thereby causing leaking next to the outside of the seal edge during transit and in use, or tearing even as initially constructed prior to filling the liner with liquid. Stress testing of the new construction also shows improved results over prior constructions in terms of less damage to the flange seal area.

It will also be understood that the rigid spout constructions of the invention also can be employed as liner fill fitments, and can be located in various suitable fill and/or discharge locations on one or more of the walls of liner 10.

I claim:

1. A container having an upright orientation in use with a side wall and a bottom end, a flexible and collapsible liquid impervious liner adapted to be received in the container and complementary thereto and having side, top and bottom walls and fill and discharge openings through which liquid contents are respectively entered and discharged, said liner comprising a tubular blank of a flexible and liquid impervious plastic sheet material, said tubular blank having a spout fitment in one of the said openings in one of said walls, said one wall comprises a plurality of plies of said flexible plastic sheet material, said fitment comprising a self-supporting rigid spout having a generally cylindrical tube extending through said liner opening and being openable at opposite ends thereof, one of said tube ends being disposed interiorly of said one liner wall and the other of said tube ends being disposed exteriorly of said one liner wall, said spout also having an external rigid flange base adjacent said one interiorly disposed tube end and extending radially outwardly in encircling relation to said tube, said spout being permanently affixed and sealed at said one end to said liner by a separate and circumferentially continuous first annular heat seal formed in a first annular weld zone between a first surface of said flange base facing toward said other tube end and an interior surface of said liner and encompassing said opening of said liner; a first backing piece of flexible and liquid impervious plastic sheet material overlying a second surface of said flange base disposed on the opposite side of said flange base from said first flange surface, said backing piece being constructed and arranged to radially encompass said one tube end and to have a marginal portion protruding radially outwardly beyond the peripheral edge of said flange base and overlying said liner interior surface, a second separate and circumferentially continuous annular heat seal formed between said backing piece and said flange base second surface in a second annular weld zone and spaced radially inwardly from said first seal in said first weld zone, and a third separate and circumferentially continuous annular heat seal formed between said backing piece marginal portion and said liner interior surface in a third annular weld zone and spaced radially outwardly from said first weld zone and spaced from both said first and second seals.

2. The combination of claim 1 wherein said one liner wall comprises a plurality of plies of said plastic sheet material and all of said plies are joined to one another and to said flange base first surface by said first annular heat seal formed in said first annular weld zone.

3. The combination of claim 2 wherein said one liner wall consists of two of said plies.

4. The combination of claim 2 wherein said one liner wall consists of three of said plies.

5. The combination of claim 1 wherein said rigid spout is of the open flange type and said backing piece has an aperture to fit in close surrounding relation to said one tube end with said one tube end protruding through said backing piece aperture into the interior of said liner.

6. The combination of claim 5 wherein said one liner wall comprises a plurality of plies of said plastic sheet material and all of said plies are joined to one another and to said flange base first surface by said first annular heat seal formed in said first annular weld zone.

7. The combination of claim 6 wherein said one liner wall consists of two of said plies.

8. The combination of claim 6 wherein said one liner wall consists of three of said plies.

9. The combination of claim 1 wherein said spout is of the closed flange type and said backing piece is imperforate and pierceable radially inwardly of said second weld zone to thereby open said one tube end for discharge of liquid therethrough from the liner interior.

10. The combination of claim 9 wherein a liquid impervious, imperforate and pierceable plastic sheet seal piece is interposed between said backing piece and said flange base second surface and joined to backing piece and flange base second surface by said second heat seal.

11. The combination of claim 10 wherein the peripheral edge of said seal piece is generally flush with the peripheral edge of said flange base.

12. The combination of claim 11 wherein a second backing piece of liquid impervious imperforate and pierceable plastic sheet material overlies said first backing piece and has a peripheral edge wider than the peripheral edge of said first piece marginal portion, said second backing piece being joined to said first backing piece by a heat seal formed therebetween and disposed in said third annular zone.

13. The combination of claim 12 wherein said one liner wall comprises a plurality of plies of said plastic sheet material and all of said plies are joined to one another and to said flange base first surface by said first annular heat seal formed in said first annular zone.

14. The combination of claim 13 wherein said one liner wall consists of two of said plies.

15. The combination of claim 13 wherein said one liner wall consists of three of said plies.

* * * * *